United States Patent [19]

Turner

[11] 4,038,662

[45] July 26, 1977

[54] DIELECTRIC SHEET MOUNTED DIPOLE ANTENNA WITH REACTIVE LOADING

[75] Inventor: Edwin M. Turner, Dayton, Ohio

[73] Assignee: Ball Brothers Research Corporation, Boulder, Colo.

[21] Appl. No.: 620,501

[22] Filed: Oct. 7, 1975

[51] Int. Cl.[2] ..... H01Q 9/16

[52] U.S. Cl. ..... 343/752; 343/794; 343/802; 343/813

[58] Field of Search ..... 343/794, 795, 802, 807, 343/818, 752, 813

[56] References Cited

U.S. PATENT DOCUMENTS

| | | | |
|---|---|---|---|
| 2,667,577 | 1/1954 | Graziano | 343/814 |
| 2,932,822 | 4/1960 | Hills et al. | 343/807 |
| 3,020,550 | 2/1962 | Beever | 343/795 |
| 3,689,929 | 9/1973 | Moody | 343/818 |
| 3,805,269 | 4/1974 | Fujimoto et al. | 343/794 |

FOREIGN PATENT DOCUMENTS

| | | | |
|---|---|---|---|
| 869,650 | 3/1953 | Germany | 343/802 |

*Primary Examiner*—Eli Lieberman
*Attorney, Agent, or Firm*—James D. Haynes

[57] ABSTRACT

A broadband antenna in the form of a multiple element interlaced dipole array is mounted on a thin elongated strip of dielectric material which is mechanically flexible, light weight and electrically small. Each dipole has a first tapered radiator section with an inductive loading section electrically connected to one end of the tapered radiator section. A capacitive end-loading section is connected to the inductive loading section. Second tapered radiator sections are joined to one another by a second inductive loading section. The inductive loading sections increase the effective electrical length of the first and second tapered radiators, respectively. A UHF gap filling conductor is connected to each of the dipoles to suppress grating lobes at the high-frequency end of the frequency spectrum received by the antenna. The two tapered radiator sections of each dipole are connected to one another by a pair of conductors which are tapered away from one another toward the output terminals of the antenna to provide a preselected output impedance to a receiver.

12 Claims, 3 Drawing Figures

DIELECTRIC SHEET MOUNTED DIPOLE ANTENNA WITH REACTIVE LOADING

BACKGROUND OF THE INVENTION

This invention relates to a broadband, lightweight, mechanically flexible antenna having a relatively small electrical length and more specifically relates to such an antenna for receiving television signals.

In the past, there has been considerable difficulty in the antenna art, particularly with respect to the television and amateur broadcast frequencies, in developing a compact, lightweight and easily installed antenna which is adaptable for use indoors as well as outdoors. As an example, an antenna was provided in the form of two matched dipoles which were mounted in a picture frame. This antenna, however, had a highly variable output impedance and low efficiency and, accordingly, was not capable of providing good television reception over the VHF and UHF frequency spectrum.

Subsequently, an approved picture frame antenna was designed wherein a television antenna was mounted on a printed circuit board which was positioned in back of a picture frame. The electrical performance of this antenna, however, was unsatisfactory for receiving signals over the entire UHF and VHF frequency spectrum. Subsequent to this, an antenna was mounted on a printed circuit board, which antenna was basically in the form of a highly modified log periodic antenna which required two channel amplifiers which were mounted directly upon the antenna. The antenna was an improvement over the prior art, since it included a pair of dipoles which were electrically isolated from one another wherein one dipole had a VHF capacitive load while the other dipole had a relatively low frequency inductive load terminated in a capacitive loading. While this antenna could receive signals over the entire UHF and VHF television frequency spectrum, the range of this antenna was not so good.

In addition to antennas specifically developed for television, other antennas have been developed which were capable of being mounted on relatively thin dielectric substrates. As an example, an elongated dipole antenna was formed of a wire construction. This antenna exhibited the characteristics of a single dipole and was not efficient for the reception of television signals unless it was made very long in order to receive the low frequency end of the television frequency spectrum. A multi-dipole antenna was provided which exhibited extremely good electrical characteristics over a bandwidth deviating in the range of 25% from the center frequency thereof. Since this antenna was of a narrow band type, it was not suitable for television reception and in addition would have had to have been inordinately long if utilized to receive the television signals at the lower end of the television spectrum.

It accordingly is an object of this invention to provide a broadband compact flexible antenna having good electrical characteristics over the entire television bandwidth while having a small electrical load.

SHORT STATEMENT OF THE INVENTION

Accordingly, the present invention relates to a flexible broadband antenna which includes a thin, elongated strip of dielectric material upon which is affixed a thin, flat, elongated conducting means which is electrically small. The conducting means is in the form of an interlaced dipole array with each dipole having a first tapered radiator section. The radiator sections are tapered in order to provide for a relatively small standing wave ratio over a 20:1 frequency range. In order to increase the efficiency and gain of the antenna at the low frequency end of the reception spectrum, an inductive loading is electrically connected to each of the first tapered sections. In order to provide for a better impedance match at the lower end of the frequency spectrum, a capacitive end loading section is connected to each inductive loading section. A second tapered section is provided in each dipole, which sections are joined together by at least one second inductive loading section. The second inductive loading section increases the effective length of the second tapered section at the lower end of the frequency spectrum, thereby providing an effective overlapping of the two dipole elements. The dipole elements are connected to an output terminal via conductors which are tapered away from one another as the conductors approach the output terminal of the antenna. By tapering the conductors, the impedance of the antenna can be matched with the input of a receiver. In order to decrease the grating lobes at the high frequency end of the reception spectrum, an auxiliary radiator is provided which is connected to the dipole array at selected points therealong so that the auxiliary conductor appears inductive while the rest of the antenna appears capacitive or vice verse, thus, this portion of the antenna provides for a more uniform impedance match over both the lower and upper ends of the frequency spectrum.

BRIEF DESCRIPTION OF THE DRAWINGS

Other objects, features and advantages of the present invention will become more fully appreciated from the following detailed description of the preferred embodiment, and the accompanying drawings in which.

DETAILED DESCRIPTION OF THE PREFERRED EMBODIMENTS

Figure 1:
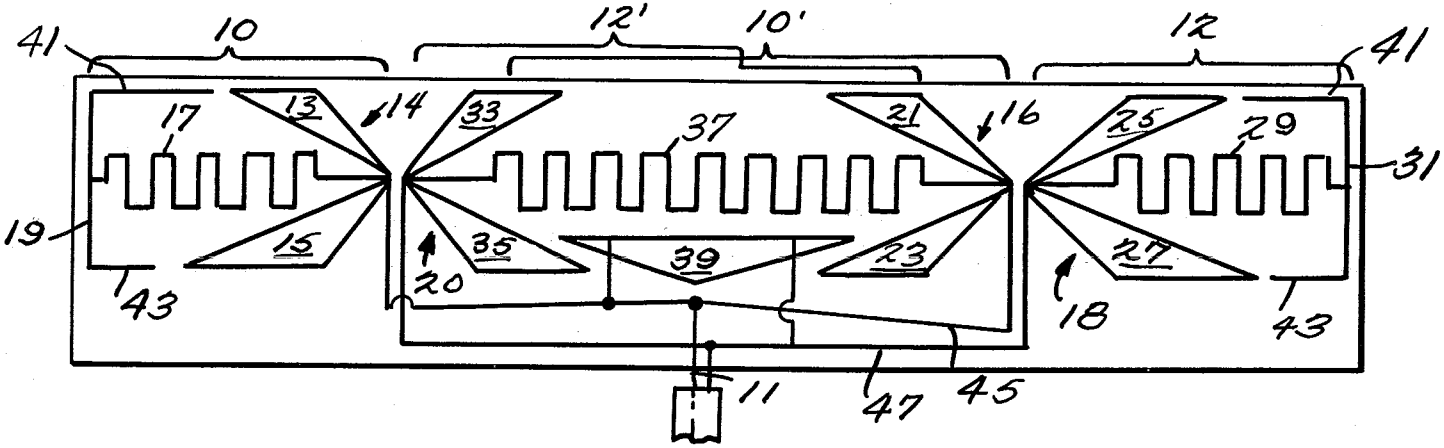
FIG. 1 is a schematic illustration of the antenna of the present invention.

Refer now to FIG. 1 where there is a schematic illustration of the antenna of the present invention for purposes of explaining the principle behind the operation of the antenna. The antenna is positioned on an elongated Mylar strip having a length of between 7 and 7½ feet, a width of about 4 to 6 inches and a thickness of about 3 to 5 mils. Mylar, as is well known in the art, is highly flexible and light weight and accordingly, the antenna can be very easily transported by rolling the antenna into a cylinder and then packing same for shipment or storage. In addition, because of the thinness of the Mylar, the antenna can be positioned under rugs, behind wall board, in the attic or in other suitable places.

For outdoor operation of the antenna, the substrate of the antenna can be made of hard, weather-resisting plastic materials. For use in the attic where considerable protection from the weather is afforded, a flexible plastic material such as, for example Cinclad Series Grade A material produced by the Cincinnati Millicon Corporation can preferably be utilized. The antenna can be mounted on the roof or on the sides of a building, depending upon the construction of the building, the location thereof and the orientation of transmitting stations with respect to the building. If the antenna is positioned on the roof of a building or on a metal surface, the antenna should be raised above the surface of the structure by means of stand-offs in order to minimize detuning and absorption losses therein.

Figure 3:
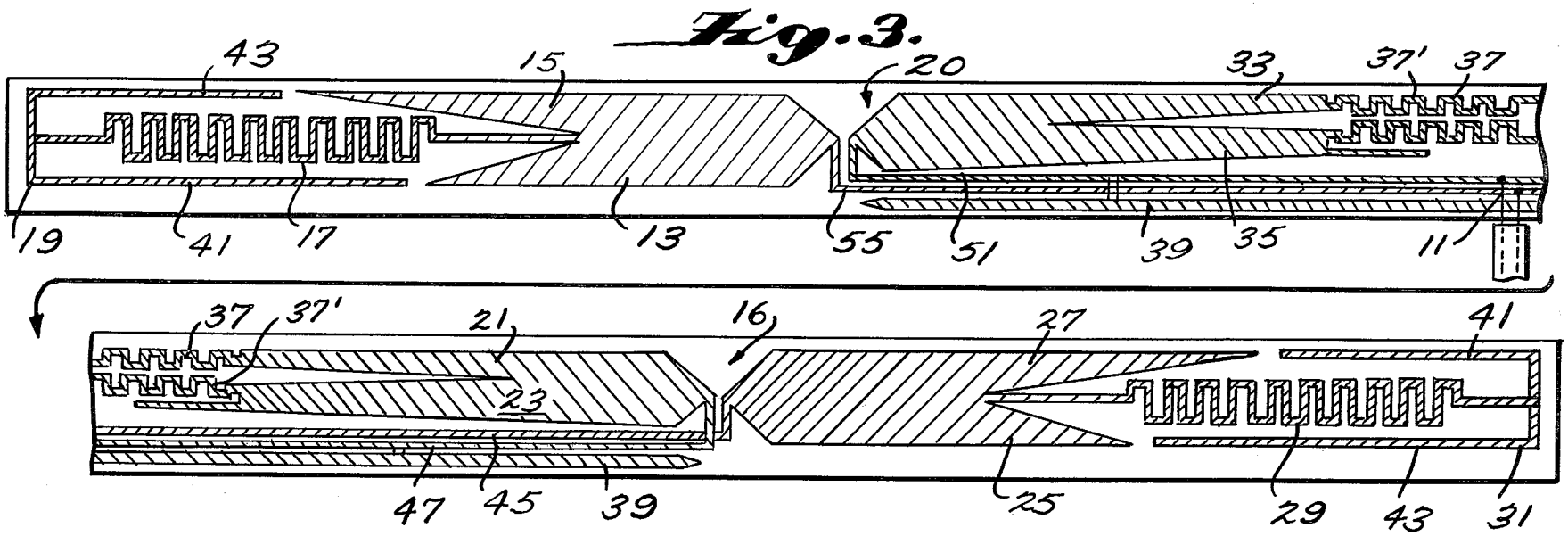
FIG. 3 is a plan view of a second embodiment of the invention.
Figure 2:
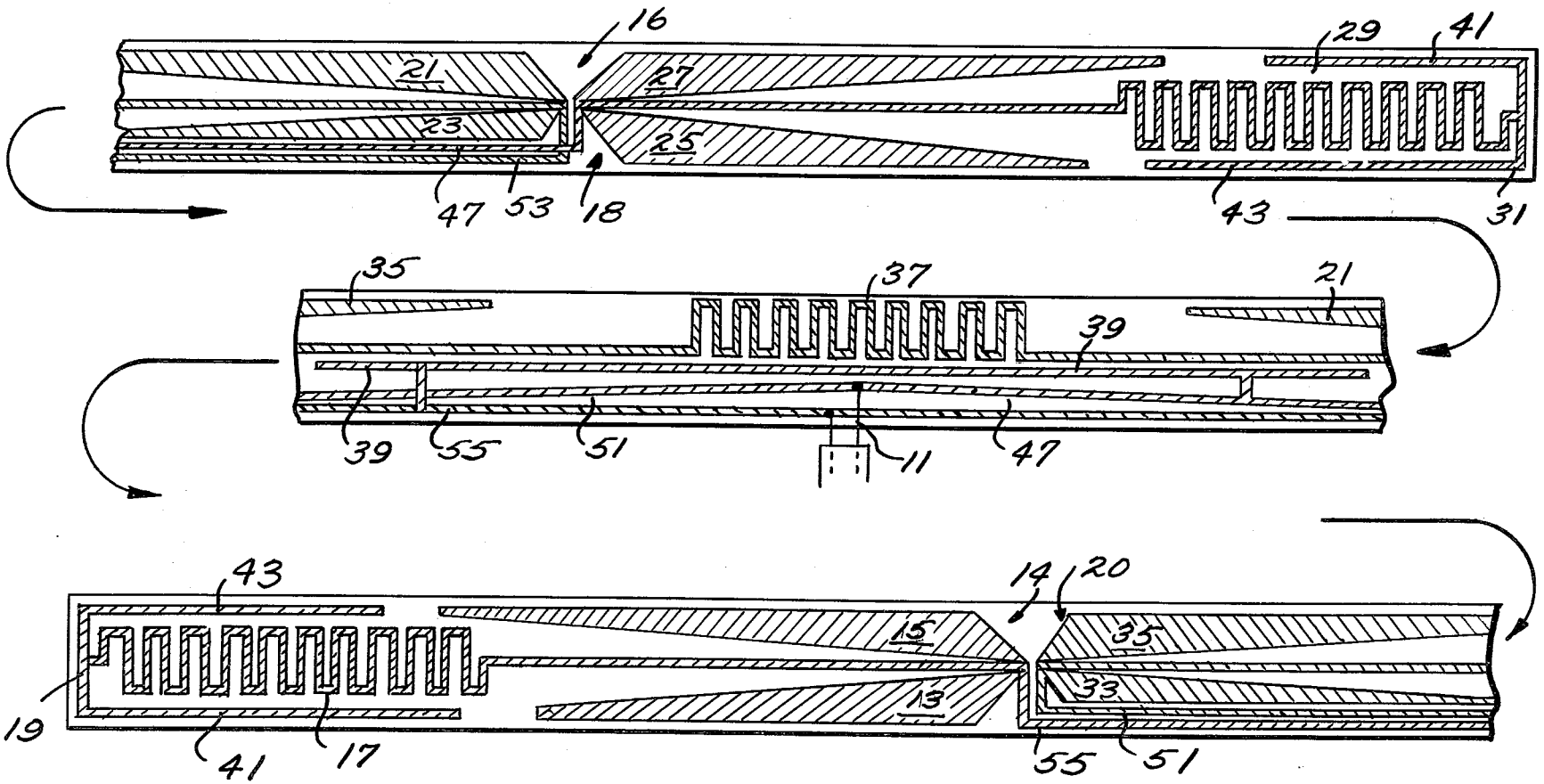
FIG. 2 is a planar view of the preferred antenna array of the present invention.

The conductive portion of the antenna is formed by depositing a one mil thick copper or aluminum coating onto the dielectric substrate, preferably in the form illustrated in FIGS. 2 or 3. The antenna essentially comprises two arrayed dipole antennas as will be generally described in connection with FIG. 1. Each of the dipoles are connected to an antenna output terminal 11 which preferably has a 300 ohm output impedance in order to provide an impedance match with the input of the receiver to which the antenna is coupled. The first dipole which comprises sections 10 and 10' includes a tapered radiator section 14 which includes a first tapered portion 13 and a second tapered portion 15. An inductive loading conductor 17 is connected at one end to the tapered section 14 and is connected at its other end to a conductive strip 19 which serves as a top loading capacitance. The other section 10' of the dipole includes a second tapered radiator section 16 which includes a first tapered radiator 21 and a second tapered radiator 23.

The second dipole which comprises sections 12 and 12' includes a first tapered conductor 25 and a second tapered conductor 27 which are electrically joined to one another as illustrated. An inductive loading which is embodied by the square wave conductor 29 is connected at one end to the tapered section 18 and at the other end to a conductor 31 which forms a top loading capacitance. The other half of the dipole includes a tapered section 20 having tapered conductors 33 and 35. The tapered conductors 33 and 35 are electrically joined together and are connected to tapered conductors 21 and 23 of the first dipole element by means of the square wave-shaped conductor 37 which forms an inductive load and a filter isolator for enhancing the reception of signsls at both ends of the frequency band. An auxiliary radiating element 39, which serves as a grating lobe suppressor, and an impedance matching device is connected in parallel across the dipole array as illustrated.

In operation, assume for example, that the antenna is being utilized to receive television signals over the entire television spectrum. As is known in the art, the television spectrum begins at 54 megahertz and ends at 960 megahertz. With specific reference to television reception, the lower end of the frequency spectrum ranges from 54 MHz to 88 MHz. The intermediate portion of the frequency spectrum ranges from 174 MHz to 220 MHz. These frequencies constitute the VHF portion of the frequency spectrum. The UHF portion of the frequency spectrum which constitutes the upper end thereof ranges from 480 megahertz to 960 megahertz. For receiving television signals at the lower end of the frequency spectrum, the antenna should ordinarily be quite long. However, in the present invention, the length of the antenna has been shortened substantially by providing an interlaced antenna array and providing inductive and capacitive compensation thereto. Thus, the sections 10, 10' of the first dipole are interlaced with the sections 12 and 12' of the second dipole and the square wave conductive structure of the inductive loading elements 17 and 29 provide a conductor which is relatively long compared to the length of the antenna traversed thereby. This effectively lengthens the electrical length of the antenna so that the antenna can present a large effective reception area to the incident television signal. In order to provide impedance matching with the impedance of free space which is 377 ohms, a capacitive loading is provided in the form of conductors 19 and 31. It has been found experimentally that the respective legs 41 and 43 of each of the capacitive loading conductors should have different lengths in order to lower the standing wave ratio. The length of the conductors 19 and 31 and the ratio of the vertical to the horizontal segments of the inductive loading elements 17 and 29 should be such that the resulting impedance provides a good impedance match with the impedance of free space, and the transmission line 11.

A second inductive loading element 37 is provided which effectively lengthens and overlaps the tapered dipole sections 16 and 20. Thus, because of the square wave structure of the inductive loading element 37, the effective length of the dipole element 16 and 20 are substantially increased.

As the frequency of the signal incident upon the antenna increases into the intermediate frequency section which ranges from 174 to 220 megahertz, the inductive loading elements 17, 29 and 37 act as filter isolators. Thus, the inductive elements 17 and 29 effectively prevent signals in this frequency range from passing therethrough and accordingly, the effective electrical length of the antenna is substantially reduced, thereby providing a better impedance match with free space at these frequencies. In addition, the inductive loading element 37 is isolated from the tapered dipole radiator elements 16 and 20, thereby effectively shortening the electrical length of these elements. In the intermediate frequency range, the tapered dipole radiator elements which are largest, that is, elements 15, 35, 23 and 27 are the most effective in receiving the transmitted signal. It has been found that by tapering the radiator elements, discontinuities are removed from the antenna which tend to cause standing waves and resonating harmonics. Thus, it was found that by tapering the radiator elements, a rather smooth, continuous impedance match was provided with respect to free space over a relatively large frequency spectrum.

The tapered radiator elements 13, 33, 21 and 25 are effective to receive the VHF frequency signals. As can be seen from FIG. 1, these radiators are of smaller size than the radiators designated by the numerals 15, 35, 23 and 27. As illustrated, these radiators have a tapered form to provide a smooth, continuous impedance match over a relatively broad frequency range. As aforementioned, the inductive loading elements 17, 29 and 37 effectively isolate the tapered elements 13, 33, 21 and 25 so that the antenna provides a relatively small electrical length for receiving the short waved VHF signals thereby improving the impedance match of the antenna with the impedance of free space.

An auxiliary radiating element and grating lobe suppressor 39 is provided which may be tapered in order to extend the bandwidth over which the element 39 is effective. As is known in the art, as the frequency of a received signal increases into the VHF frequency domain, the antenna pattern becomes less well defined because of a number of grating lobes which are formed therein. The element 39 corrects or compensates for this drawback. The grating lobe suppressor 39 is connected to the transmission lines 45 and 47 at a point along the grating lobe suppressor 39 such that the loop formed by the connection of the grating lobe suppressor to the transmission lines 45 and 47 is initially inductive and then as the frequency of the input signal increases into the upper VHF range, it becomes capacitive. Thus, an improved impedance match with the free space is provided since the remainder of the antenna becomes inductive at these high frequencies. The particular point in which the element 39 is connected to the transmission lines 45 and 47 is best determined on an experimental basis since theoretical calculations therefor are not presently available.

Another important feature to the present invention is the provision of tapering transmission lines 45 and 47 which connect the respective dipoles of the interlaced dipole array to the output terminal 11. The transmission lines 45 and 47 are tapered away from one another as they approach the transmission terminal 11 in order to increase the impedance presented to the receiver connected to the terminals 11. Thus, each dipole conventionally presents a 300 ohm resistance. However, because of the tapered transmission lines 45 and 47 the resistance presented by each dipole is increased to 600 ohms. Since the two dipoles are connected in parallel, the output impedance to the receiver is effectively reduced to 300 ohms.

Refer now to FIG. 2 which is a scale model of one preferred embodiment of the antenna of the present invention. In this figure, the numerals of FIG. 1 correspond to the same elements in FIG. 2. The antenna of FIG. 2 comprises an array of two interlaced dipoles which are connected together at terminal 11. One dipole includes a tapered section 18 having a first tapered conductor 25 and a second tapered conductor 27. Connected to the tapered conductors 25 and 27 is a loading element 29 which is in the form of a square wave conductive strip in order to provide an increased effective length for the antenna at the lower end of the frequency spectrum received by the antenna. Connected to the inductive loading element 29 is a capacitive loading element 31 which includes a relatively short leg 41 and a relatively long leg 43. As aforementioned, the purpose for the capacitive loading element 31 is to provide an improved impedance match with free space over the frequency range at the lower end of the television frequency spectrum. The length of the conductor legs 41 and 43 and the ratio of the horizontal to vertical portions of the inductive loading conductor 29 are selected so that the standing wave ratio for the antenna is at a minimum over the lower end of the received frequency spectrum. The tapered dipole radiator 18 is connected to the output terminal 11 via transmission line 47 and is connected to a second tapered radiating section on the other half of the antenna by means of the transmission line 51. As illustrated, the tapered conductor 27 is relatively large and is most effective when receiving transmitted signals in the 174 to 220 megahertz range while tapered conductor 25 is relatively small and is most effective in receiving signals in the UHF range. The antenna also includes a second tapered radiator section 16 which includes a relatively large conductor 21 and a relatively small conductor 23. The tapered radiating section 16 is connected to the tapered radiating section 14 on the opposite side of the antenna via transmission lines 53 and 55. These tapered radiators are connected to one another via an inductive loading conductor 37 which is in the form of a square wave. As aforementioned, the purpose for the inductive loading conductor 37 is to increase the effective length of the tapered dipole sections 14 and 16 and to isolate the tapered dipole section 16 from dipole section 14 on the opposite end of the antenna when the frequency being received is relatively high.

An auxiliary radiating element 39 is provided for suppressing the grating lobes when UHF frequency signals are being received. The grating lobe suppressor 39 is connected to transmission line 45 and transmission line 55 at points along the grating lobe suppressor such that the impedance presented thereby is capacitive for the lower frequencies and inductive for the higher frequencies. Thus, this element acts as a shunt impedance which cancels out the reactive power of the remainder of the antenna to thereby lower the standing wave ratio and improve the impedance match of the antenna with free space. As illustrated, the conductors 45 and 47 are tapered away from one another as they approach the terminal 11 in order to increase the impedance presented by each dipole to 600 ohms. Since the dipoles are connected in parallel, the outout impedance presented to the receiver (not shown) is 300 ohms.

Section 10 is the mirror image of section 12 and section 12' is the mirror image of section 10'. Accordingly, these sections will not be described herein in detail since the electrical operations thereof is similar to the electrical operation of sections 10' and 12.

Refer now to FIG. 3 which is an alternative embodiment of the present invention. The antenna illustrated in FIG. 3 is shown to scale and is broken into two sections to present the entire antenna in the drawing. As in the aforementioned embodiments, the antenna includes two arrayed dipoles which are interlaced by means of a pair of inductive loading elements 37. This antenna differs from the antenna of FIG. 2 primarily in that two inductive loading elements 37 and 37' are connected to the tapered radiating sections 16 and 20 at the ends thereof as illustrated. Thus, the upper inductive loading element 37 is connected to the end of a smaller tapered conductor 21. The lower inductive loading element 37' is connected to the relatively large tapered radiating conductor 23. The opposite ends of the inductive loading elements are connected, respectively, to the tapered radiating conductors 33 and 35. By using the two inductive loading elements in parallel, the effective electrical length of the antenna is reduced.

A second significant difference between this antenna and the antenna of FIGS. 1 and 2 is that the transmission lines are not tapered and, accordingly, impedance matching by the use of commercially available ferrite transformers which have a substantially constant inductive reaction can be utilized. The transformer would be connected to terminal 11 to match the impedance of the antenna to the input impedance of a receiver over the entire frequency spectrum received. As an alternative, the feed points for the antenna can be changed from a position which is roughly one-fourth the distance from the ends of the antenna to another position in order to correct for the impedance missmatch. In this regard is should be noted that if a conventional 72 ohm coaxial cable is utilized in lieu of the 300 ohm twin lead transmission line, the tapering of the transmission lines 45 and 47 could be appropriately varied to achieve the lower impedance, the feed points for the dipole elements changed or a constant impedance ferrite transformer utilized to match the impedance of the antenna to the transmission line.

In each of the aforementioned embodiments, the left and right sides of the dipole array give horizontal patterns with a beam width of approximately 70°. Because of the interlacing of the center sections by means of the inductive loading, the beam width in the 54 to 110 megahertz band will be approximately 70°, while at a frequency range of about 220 megahertz, the beamwidth will be approximately 45°. It can be seen that the present invention relates to an improved antenna operable over an extremely broad frequency spectrum wherein the antenna is of exceedingly light weight and mechanically flexible so that the antenna can be easily transported or stored and installed in any desirable location. The antenna has a relatively small electrical length because of inductive loading at the right and left ends of the antenna and because of interlacing of the dipole array at the center of the antenna. The overlapping or interlacing of the center section of the antenna is possible because the currents on the conductors in this portion of the antenna are in the same direction and accordingly, do not cancel. The extreme bandwidth of the antenna structure is accounted for by the fact that each of the sections of the antenna is compensated in frequency with inductive and capacitive loading and appropriate tapering of the dipole elements. Thus, the loading is graduated so that the transition to the respective frequency bands received is smooth, thereby resulting in fewer resonating elements and a consequent lower standing wave ratio over the frequency bandwidth received.

A further advantage to the antenna is that it is bidirectional in a horizontal plane since the antenna is symmetrical in the forward and backward directions when used without a reflector. However, if one were to use a reflector, the forward lobe of the antenna would be enhanced and the backward lobe would be attenuated. Because the antenna is elongated, that is, the length thereof is substantially greater than the width thereof, the antenna can be rotated about the longitudinal axis thereof and still provide good reception.

While the preferred embodiments of the present invention have been disclosed, it should be understood that there may be other alternative embodiments which fall within the spirit and scope of the invention as defined by the appended claims.

What is claimed is:

1. A broadband television antenna comprising a substrate formed of a thin, elongated strip of dielectric material, said substrate having a width which is many orders of magnitude smaller than the length thereof, and a thin, elongated electrically small conducting means mounted on said substrate, said conducting means being in the form of an interlaced dipole array, each dipole having a first tapered conductive radiator for receiving electromagnetic signals over a broad frequency band, an inductive loading undulating conductor connected at one end thereof to each of said first tapered conductors, a capacitive loading conductor connected to the other end of each of said undulating conductors, said inductive and capacitive loading conductors increasing the effective electrical length of said dipole array for receiving relatively low frequency electromagnetic signals, each dipole having a second tapered conductive radiator for receiving electromagnetic signals over a broad frequency band, a second inductive loading undulating conductor connected at one end of one of said second tapered conductors and at the other end to the other of said second tapered conductors of another dipole of said dipole array, said second undulating conductor increasing the effective electrical length of each of said first and second tapered dipoles, and means for connecting said dipoles to an output terminal.

2. A broadband television antenna comprising a substrate formed of a thin, elongated strip of dielectric material, said substrate having a width which is many orders of magnitude smaller than the length thereof, and a thin, elongated electrically small conducting means mounted on said substrate, said conducting means being in the form of an interlaced dipole array, each dipole having a first tapered conductive radiator for receiving electromagnetic signals over a broad frequency band, an inductive loading undulating conductor connected at one end thereof to each of said first tapered conductors, a capacitive loading conductor connected to the other end of each of said undulating conductors, said inductive and capacitive loading conductors increasing the effective electrical length of said dipole array for receiving relatively low frequency electromagnetic signals, each dipole having a second tapered conductive radiator for receiving electromagnetic signals over a broad frequency band, a second inductive loading undulating conductor connected at one end to one of said second tapered conductors and at the other end to the other of said second tapered conductors of another dipole of said dipole array, said second undulating conductor increasing the effective electrical length of each of said first and second tapered dipoles, means for suppressing grating lobes, said means including an auxiliary radiating conductor, and means for connecting said auxiliary radiating conductor to said dipole array at selected points along said auxiliary conductor wherein said grating lobe suppressing means provides a capacitive reactance at relatively high frequencies and an inductive reactance at relatively low frequencies, and means for conducting said dipoles to an output terminal.

3. The antenna of claim 2 wherein said substrate is capable of being rolled upon itself when stored and capable of being unrolled into a planar sheet when operable.

4. The antenna of claim 3 wherein said substrate is Mylar.

5. The antenna of claim 2 wherein said means for connecting said dipoles to an output terminal comprises at least two conductors for connecting said first and second tapered radiator conductors in each dipole of said array to one another, said conductors being tapered with respect to one another to provide a predetermined output impedance at said output terminals.

6. The antenna of claim 5 wherein each of said tapered conductors of said dipole array comprises a first relatively long tapered conductor for receiving electromagnetic signals of intermediate frequency and a second relatively short tapered conductor for receiving electromagnetic signals of relatively high frequency.

7. A flexible broadband antenna comprising a thin, elongated strip of dielectric material, and a thin, flat, elongated electrically small conducting means mounted on said dielectric material, said conducting means being in the form of an interlaced dipole array, each dipole having a first tapered radiator section, an inductive loading section electrically connected at one end thereof to each of said first tapered sections, a capacitive end loading section connected to each of said inductive loading sections at the other end thereof, each dipole having a second tapered radiator section, said second tapered radiator section of each dipole being joined together by a second inductive loading section, said second inductive loading section increasing the effective electrical lengths of said antenna.

8. A broadband television antenna comprising a substrate formed of a thin, elongated strip of dielectric material, said substrate having a width which is many orders of magnitude smaller than the length thereof, and a thin, elongated electrically small conducting means mounted on said substrate, said conducting means being in the form of an interlaced dipole array, each dipole having a first tapered conductive radiator for receiving electromagnetic signals over a broad frequency band, an inductive loading undulating conductor connected at one end thereof to each of said first tapered other end of each of said undulating conductors, said inductive and capacitive loading conductors increasing the effective electrical length of said dipole array for receiving relatively low frequency electromagnetic signals, each dipole having a second tapered conductive radiator for receiving electromagnetic signals over a broad frequency band, a second inductive loading undulating conductor connected at one end to one of said second tapered conductors and at the other end to the other of said second tapered conductors of another dipole of said dipole array, said second undulating conductor increasing the effective electrical length of each of said first and second tapered dipoles, means for connecting said dipoles to an output terminal, and means for suppressing grating lobes when receiving relatively high frequency electromagnetic signals, said grating lobes suppressing means comprising an auxiliary radiating conductor, and means for connecting said auxiliary conductor to said dipole array at selected points along said auxiliary conductor, said suppressing means providing a capacitive reactance at relatively high frequencies.

9. The antenna of claim 8 wherein said undulating conductive loading conductors have a square wave shape and wherein said capacitive loading conductors have two conductive legs, one of said conductive legs being longer than the other.

10. The antenna of claim 9 wherein said means for connecting said dipole array to said output terminal comprises at least two conductors for connecting said first and second tapered radiator conductors in each dipole of said array to one another, and means for varying the output impedance of said antenna to a predetermined level.

11. The antenna of claim 10 wherein said impedance varying means comprises said conductors for connecting said first and second tapered radiator sections to one another being tapered with respect to one another to provide a preselected output impedance.

12. The antenna of claim 10 wherein each of said tapered radiator conductors of said dipole array comprises a first relatively long tapered conductor for receiving electromagnetic signals of intermediate frequency and a second relatively short tapered conductor for receiving electromagnetic signals of relatively high frequency.

* * * * *